United States Patent [19]

Wahren et al.

[11] 4,024,630

[45] May 24, 1977

[54] MACHINE FOR MANUFACTURING CABLE FORMS

[75] Inventors: Carl Johan Alexander Wahren, Doncaster East; Leon Alexandra Merdy, Canterbury, both of Australia

[73] Assignee: L. M. Ericsson Pty. Ltd., Australia

[22] Filed: Mar. 12, 1975

[21] Appl. No.: 557,609

Related U.S. Application Data

[63] Continuation of Ser. No. 465,144, April 26, 1974, abandoned.

[30] Foreign Application Priority Data

Apr. 26, 1973 Australia ..... 3080/73

[52] U.S. Cl. ..... 29/624; 29/564.4; 29/760

[51] Int. Cl.[2] ..... H01B 13/06; H01B 13/02

[58] Field of Search ..... 29/630 A, 630 R, 203 P, 29/203 MW, 203 B, 624; 140/93 R

[56] References Cited

UNITED STATES PATENTS

| | | | |
|---|---|---|---|
| 1,013,958 | 1/1912 | Schröter | 29/203 MW |
| 3,103,735 | 9/1963 | Bos et al. | 29/33 |
| 3,127,669 | 4/1964 | Reber et al. | 29/208 F |
| 3,185,183 | 5/1965 | Loy | 140/93 |
| 3,514,835 | 6/1970 | Etchison, Jr. et al. | 140/93 R |
| 3,624,676 | 11/1971 | Whitney et al. | 29/203 B |
| 3,693,228 | 9/1972 | Logan | 29/203 MW |
| 3,699,630 | 10/1972 | Tarbox et al. | 29/203 MW |
| 3,766,624 | 10/1973 | Grebe et al. | 29/203 MW |
| 3,803,696 | 4/1974 | Harms et al. | 29/203 B |
| 3,842,496 | 10/1974 | Mercer | 29/203 P |
| 3,857,154 | 12/1974 | Hammond et al. | 29/203 P |

*Primary Examiner*—C.W. Lanham
*Assistant Examiner*—Daniel C. Crane
*Attorney, Agent, or Firm*—Cushman, Darby & Cushman

[57] ABSTRACT

The invention relates to a machine for manufacturing cable forms of the kind used, for example, in relay sets. The machine is fully automatic insofar as the cables are formed at least to the stage where each wire is terminated with the insulation stripped from the ends, the ends being arranged such that when the manufactured cable form is placed on the relay set or other apparatus the wire ends are in the optimum position for connection to the terminals of the apparatus. The machine comprises a holding table slidable along a longitudinal frame and supporting a plurality of holding clutches simulating the configuration of terminals which, in use, the wires will be connected. The holding clutches firmly hold the ends of wires being used to make the cable form. A rotary indexing head is mounted above the table and is adapted to actuate any one of a plurality of different wires into an operating position wherein it may be introduced into a holding clutch. The head is slidable on the frame in a direction transverse of the sliding direction of the table and a numerical controller is programmed to provide positions for the table and the head to enable any wire to be introduced to any clutch and be routed along a predetermined path to any other clutch. Cutting and stripping blades move with the head and are arranged immediately below the wire in the active position. A returning mechanism in the form of spaced opposed discs is also arranged to move with the head and the discs are disposed immediately below the blades. The discs are adapted to grip a wire passing therebetween and move vertically between the blades and the table. Rotation of the discs through 180° during said vertical movement causes the end of a routed wire to be inverted for introduction into a holding clutch. A checking circuit ensures that each wire is properly introduced into a holding clutch prior to a routing operation, with the insulation properly stripped from the end.

28 Claims, 13 Drawing Figures

49
47
48
36
46
50
101
8
29
75
95
99
103
97
79
78
74
93
54
100
98
102
45
76
96
22
72
42
67
43
76
96
90
53
91
69
80
81
56
70
82
71
68
66
67
29
33
33
65
65
61
31
32
59
62
61
62
23
21
32
8
58

MACHINE FOR MANUFACTURING CABLE FORMS

This is a continuation, of application Ser. No. 465,144 filed Apr. 26, 1974, now abandoned.

This invention relates to the manufacture of cable forms and more particularly to an improved machine for automatically manufacturing cable forms of the kind used, for example, in relay sets.

A cable form consists of may wires which may differ is size and/or colour of insulation. The wires are adapted to extend between many different points in a system and are usually bound or strapped together where they extend over a common path. In many cases manufacture of a cable form is achieved by direct manual wiring onto the apparatus. For example, in providing a cable form for a relay set it is a common practice to manually wire directly onto the relay terminals. Alternatively, the cable form may be made manually on a forming board and the completed form placed on the relay set for soldering each wire to its respective terminal.

A more advance technique for producing cable forms involves the use of semi-automated machinery which combines automatic programmed wire routing with manual termination and stripping of insulation. Although the technique is far more efficient than the fully manual methods the machines require an operator and therefore the overall efficiency of manufacture is still subjected to the whims of the operator.

It is therefore an object of this invention to provide an improved machine for manufacturing cable forms, which machine is fully automatic insofar as the cable is formed at least to the stage where only strapping of the wires remains a manual operation, the terminating and insulation stripping processes being carried out automatically by the machine.

Accordingly the invention provides a machine for manufacturing cable forms, said machine including a plurality of holding clutches for securely holding the ends of wires bieng used to make the cable form, said holding clutches being arranged in space relationship to simulate the relative spacing of terminals to which said wires will, in use, be connected, wire feed means moveable automatically relative to said clutches for introducing the end of a pre-selected wire into a predetermined one of said clutches and routing said wire along a predetermined path to a further predetermined one of said clutches, cutting and stripping blades for automatically cutting said wire and stripping the insulation adjacent the cut end prior to said introducing and, after said routing, for cutting the wire and stripping the insulation from adjacent the end of the routed wire, returning means for introducing said last mentioned end into said further clutch, and control means for controlling the operation of said machine.

Figure 1:
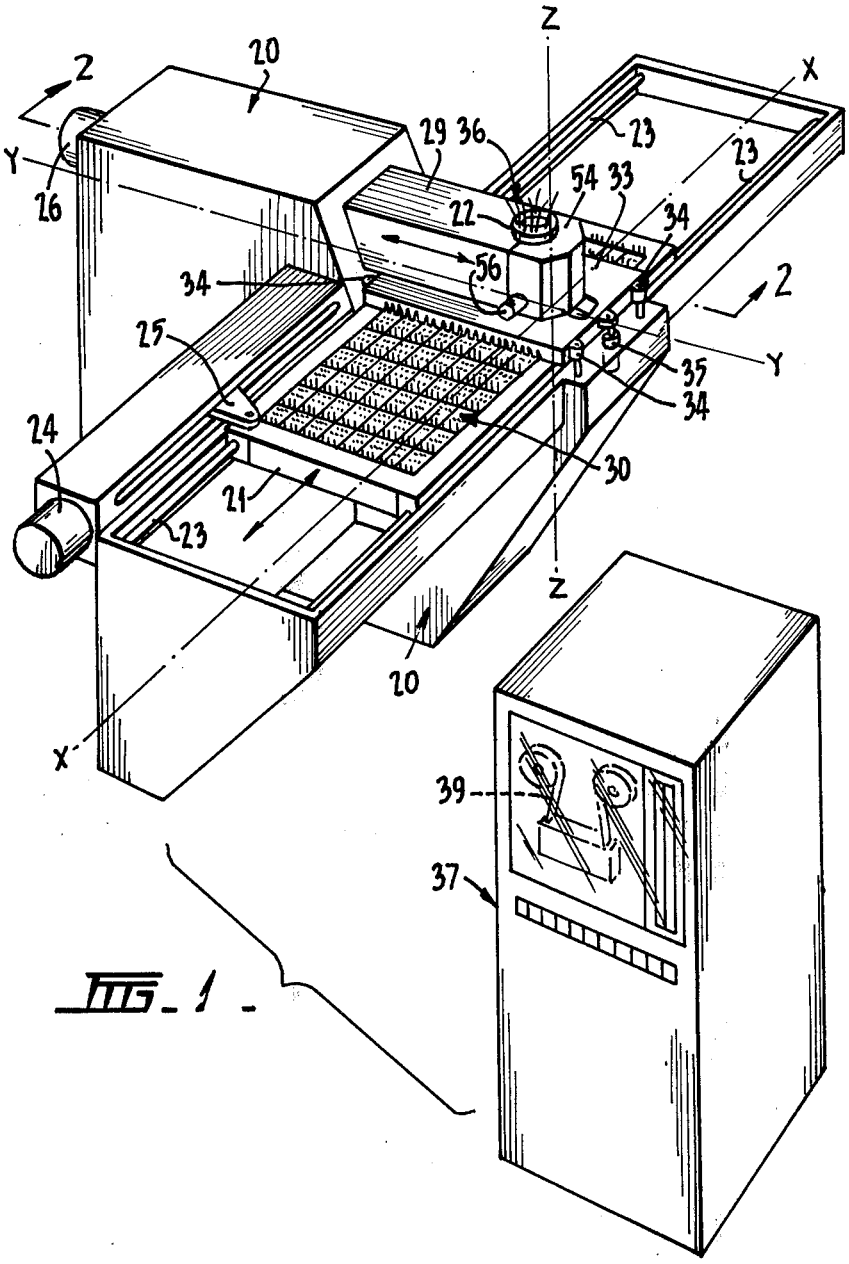
Figure 2:
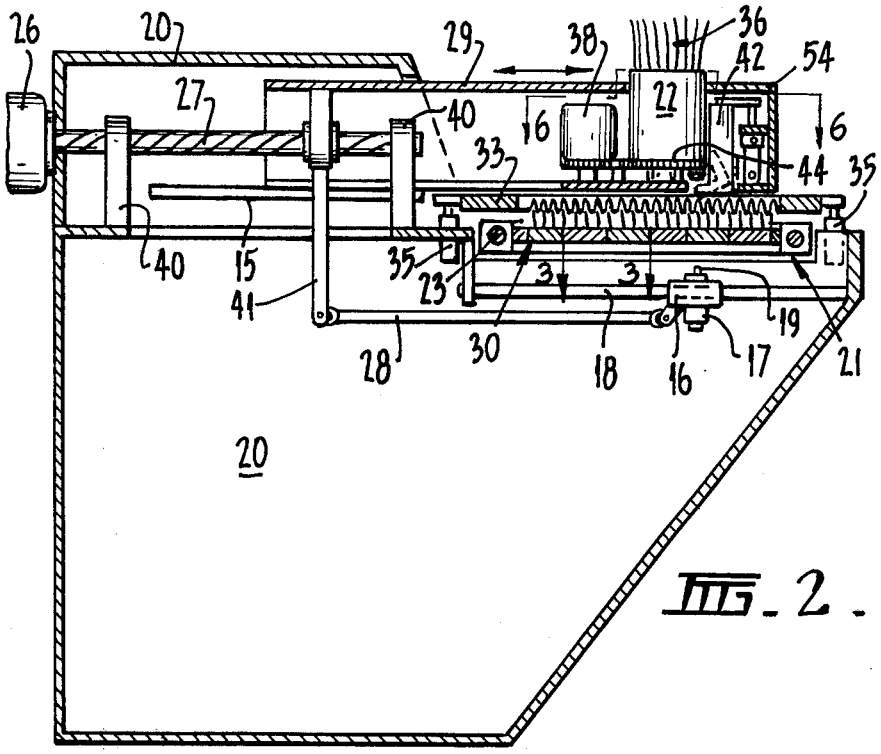
Figure 6:
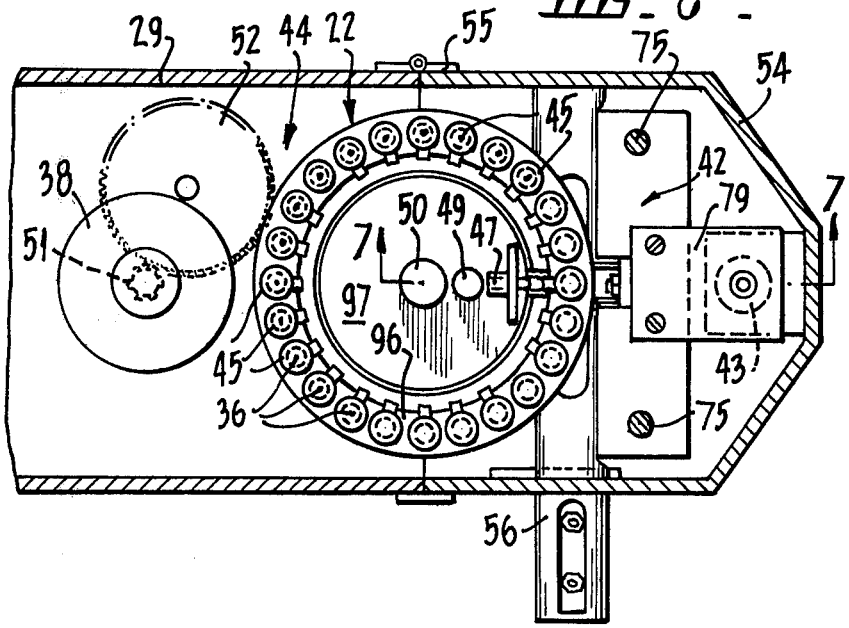
Figure 3:
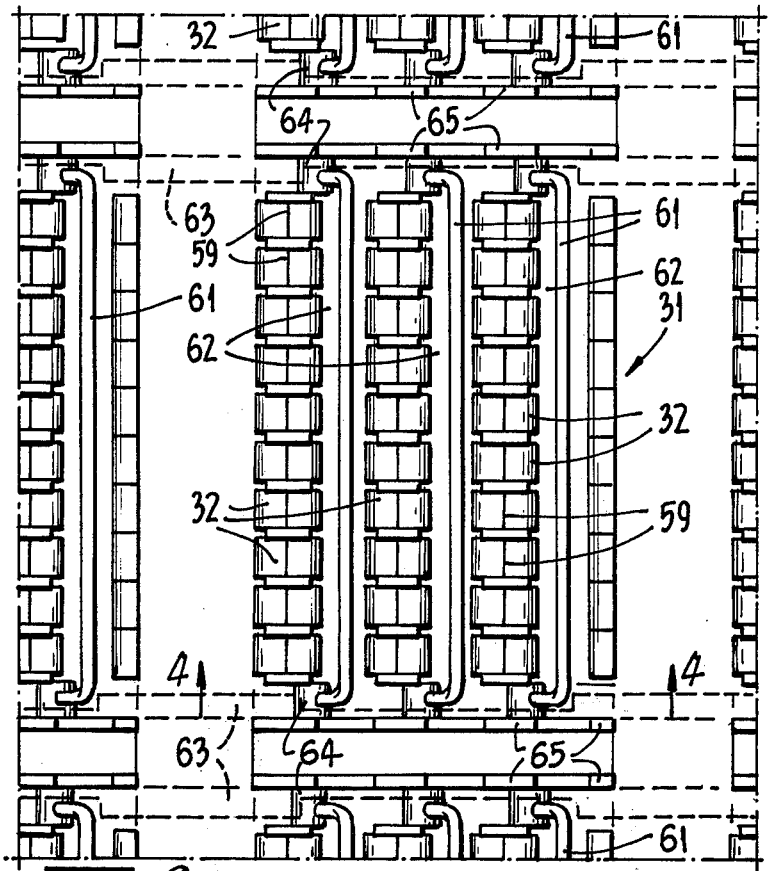
Figure 5:
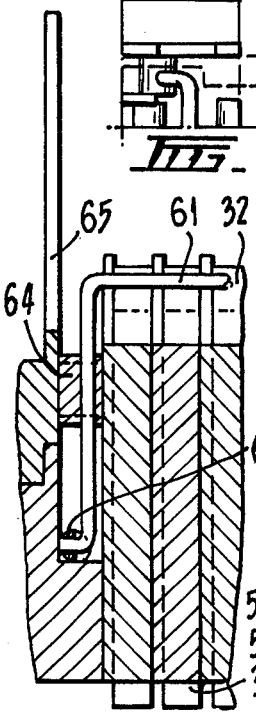
Figure 4:
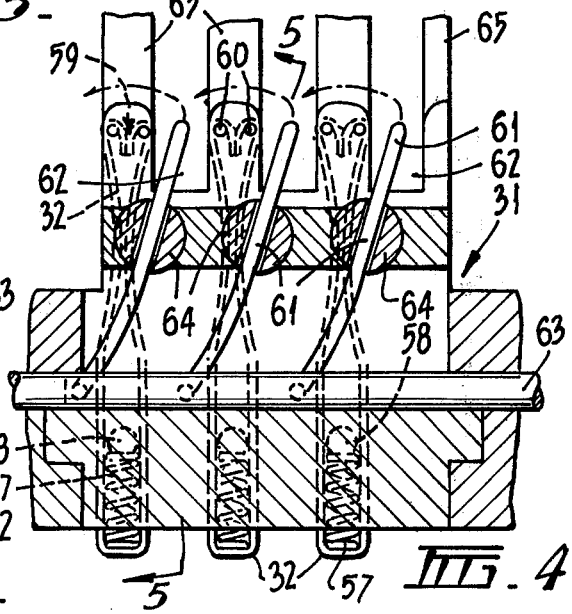
Figure 7:
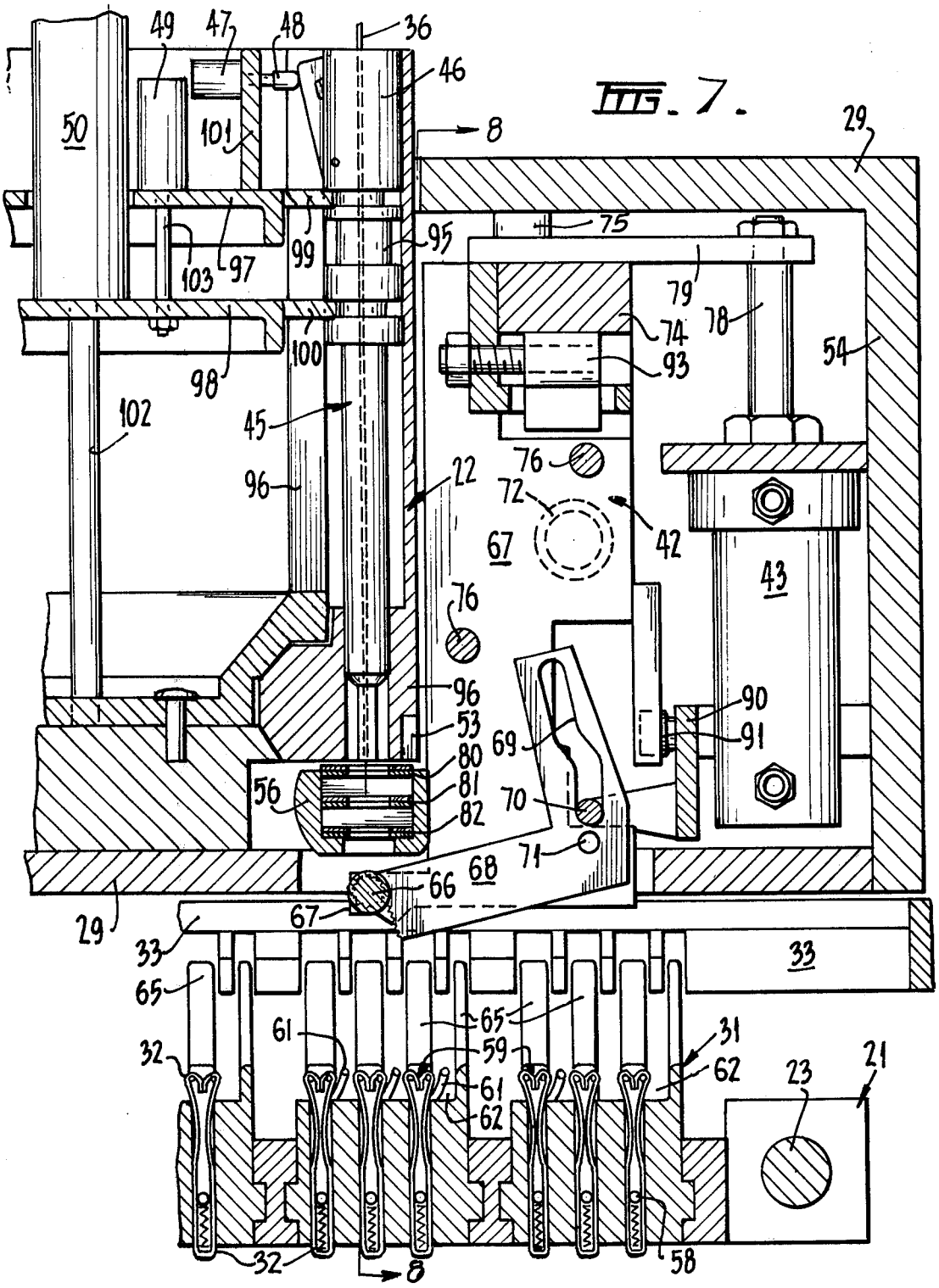
Figure 8:
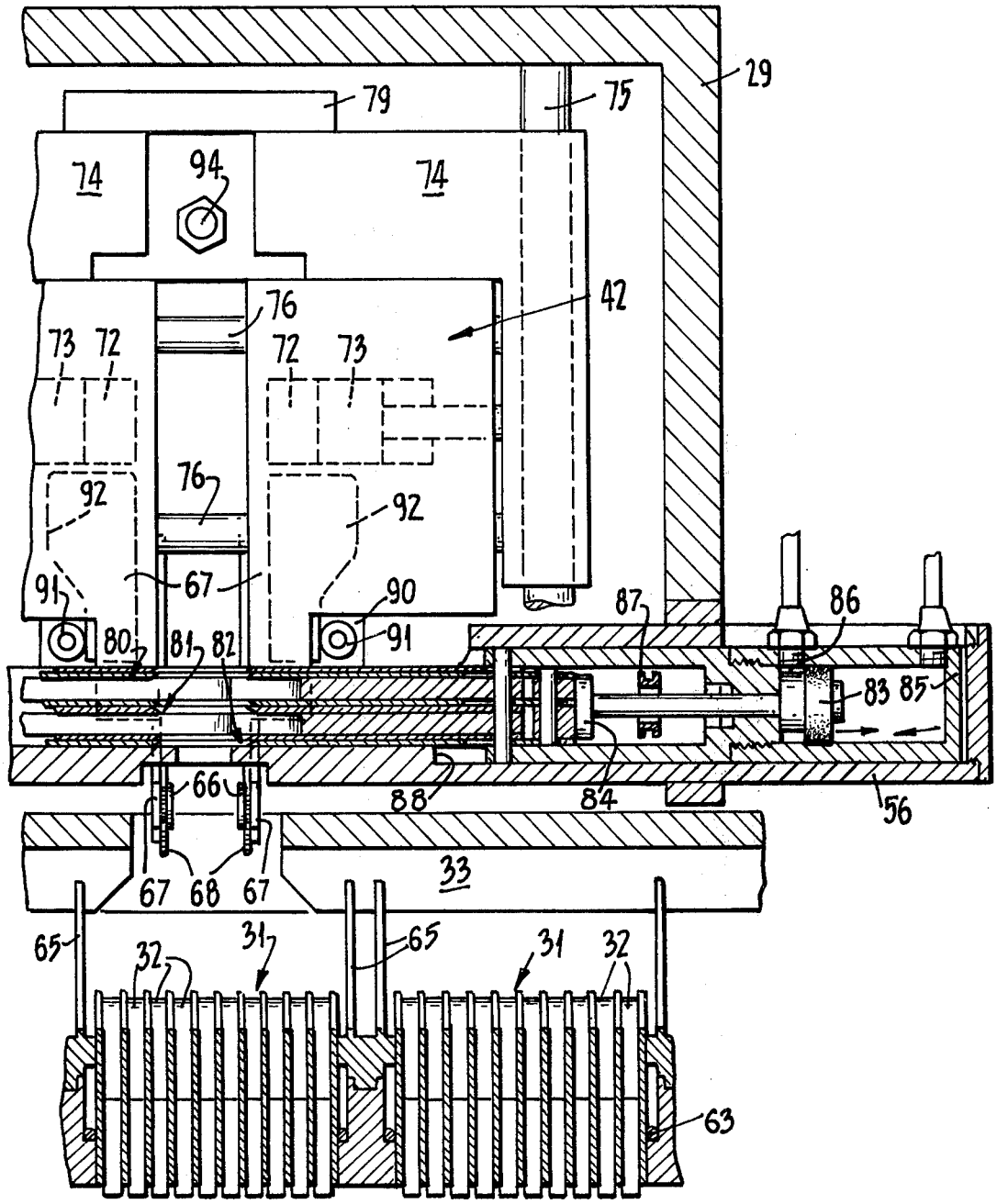
Figure 9:
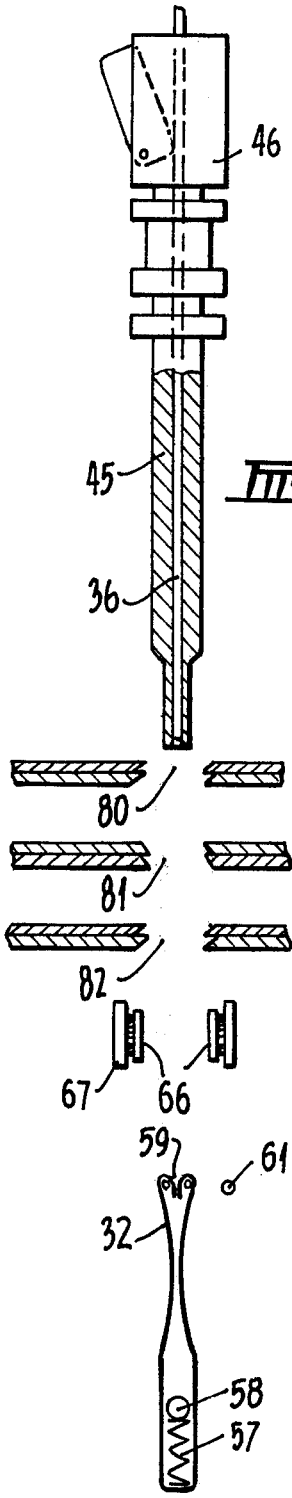

In order that the invention may be more readily understood one particular embodiment will now be described in detail with reference to the accompanying drawings wherein, FIG. 1 is a perspective view of the machine and associated numerical controller according to the embodiment, FIG. 2 is an enlarged sectional view along the line 2—2 of FIG. 1, FIG. 3 is an enlarged sectional view along the line 3—3 of FIG. 2, FIG. 4 is a sectional view along the line 4—4 of FIG. 3, FIG. 5 is a sectional view along the line 5—5 of FIG. 4, FIG. 6 is an enlarged sectional view along the line 6—6 of FIG. 2, FIG. 7 is an enlarged sectional view taken along the line 7—7 of FIG. 6, FIG. 8 is a sectional view taken along the line 8—8 of FIG. 7 and FIGS. 9 to 13 diagramatically illustrate the various operations involved in cutting, stripping and termination a wire.

Throughout the drawings like reference numerals are used to designate like or similar parts.

The machine illustrated in FIG. 1 comprises basically a base or stand 20 which slidably supports a holding table 21 and a rotary indexing head 22 arranged above the plane of the holding table 21.

The holding table 21 is arranged to slide in the direction of an axis x—x whilst the indexing head 22 is arranged to slide in the direction of an axis y—y. The holding table slides on rods 23 and movement is controlled by a longitudinal stepping motor 24 and associated lead screw (not shown). The holding table 21 is connected to the lead screw by a bracket 25. Similarly, movement of the indexing head 22 is controlled by a longitudinal stepping motor 26 via lead screw 27 (FIG. 2) and transverse slide 29 which supports the indexing head 22.

The holding table 21 removably supports a series 30 of holding clutch clusters which simulate the configuration of a relay spring set and tag terminals. Each clutch cluster 31 (FIG. 3) is shown to comprise 30 actual holding clutches 32, that is, three rows of ten clutches. The clutches 32 hold the ends of the individual wires being used to make the cable form.

A compacting bar 33 is mounted between the holding table 21 and the transverse slide 29. The compacting bar 33 is mounted to slide vertically on supports 34 when actuated by air cylinders 35 placed at opposite ends of the bar 33.

The rotary indexing head 22 is of cylindrical configuraton and is adapted to receive twenty two different wires 36 from respective spools (not shown) mounted above the machine. Any one of the wires 36 may be actuated into an operating position wherein it aligns with an axis z—z. A numerical controller 37 controls a stepping motor 38 (FIG. 2) which rotates the indexing head 22 to align a selected one of the wires 36 with the *z* axis. The numerical controller 37 also controls the stepping motors 24 and 26 to position the selected wire over any one of the holding clutches 32 of the holding table 21. In other words by specifying *x* and *y* co-ordinates and a position for the stepping motor 38 (FIG. 2) to index a wire into the operating position, it is possible to locate any wire 36 above any clutch 32. A programmed punch tape 39 controls the numerical controller 37 to locate any wire above any clutch and also to route the wire along a predetermined path to any other clutch 32.

The sectional view in FIG. 2 of the transverse slide 29 more clearly shows the relative position of the various parts. The lead screw 27 is supported in bearings 40 and drives the transverse slide 29 through geared connection 41. Bearings 15 slidably support the transverse slide 29. The connection 41 extends downwardly and connects with one end of a connecting rod 28, the other end of the connecting rod 28 being connected to bracket 16 supporting an air cylinder 17. The bracket 16 is slidably mounted on transverse rods 18 connected to the base 20. Actuation of the air cylinder 17 opens a clutch of the holding table 29 by means of pin 19 as will become apparent further on below. The pin 19 is in vertical alignment with the clutch in use and since it slides with the transverse slide 29 it always remains in said alignment.

A returning mechanism 42 is arranged adjacent to the rotary indexing head 22 and is actuated by an air cylinder 43 to perform the function of returning the cut end of a routed wire into the desired clutch as will be described herein below. The stepping motor 38 drives the indexing head 22 through a gear train 44.

Reference should now be made to FIG. 6 which is a sectional view showing essentially the indexing head 22 and associated motor 38 in plan view. The rotary indexing head 22 is a hollow cylinder having twenty four tubular bores uniformally spaced around the wall of the cylinder. Twenty two of the bores accommodate tubular pencils 45 which may slide vertically within the bores. The longitudinal axes of the pencils 45 are in the direction of the $z$ axis and each of the wires 36 extend through a respective pencil 45. The pencils 45 project upwardly beyond the casing and a clutch mechanism 46 (FIG. 7) is located at the top of each pencil. The rotary indexing head 22 is rotationally mounted on a fixed hub 96 connected to the transverse slide 29.

The clutch mechanism is adapted to grip the wire entering the top of the pencil and move vertically with the pencil or with respect to the pencil as will be explained in detail below. An air cylinder 47 located within the indexing head 22 actuates the clutch to release the wire by means of push rod 48. Further air cylinders 49 and 50 are also located within the indexing head 22 to control vertical movement of the clutch 46 with respect to the pencil 45 and of the clutch 46 together with the pencil 45, respectively. The integers within the indexing head 22 are more clearly shown in FIG. 7. The gear train 44 (FIG. 2) is shown in FIG. 6 to comprise a gear 51 attached to the shaft of motor 38, and intermediate gear 52 and a gear 53 formed around the bottom of the indexing head 22.

The transverse slide 29 has an end portion 54 which is pivoted at 55 to enable opening of the slide 29 and access to the indexing head 22, returning mechanism 42 and other associated parts. A blade cylinder 56 is mounted in the end portion 54 and projects from the side to enable removal of the cylinder 56. The blade cylinder 56 incorporates cutting and stripping blades and their pneumatic control as will be described below. An adjustable stop 87 slides through the cylinder 56 and may be varied to alter movement of the blades for different wire sizes as will also be described below.

Reference should now be made to FIGS. 3, 4 and 5 which show various views of a single clutch cluster 31. As mentioned above the clutches of each cluster are arranged in three rows of ten clutches which simulate the tag terminals of a relay spring set. Each clutch 32 is formed of spring steel bent into the shape illustrated by the dotted lines of FIG. 4. Each clutch is spring biased in a downward direction by spring 57 bearing on pin 58. Upward movement of a clutch 32 causes jaws 59 at the top of the clutch to open since the pins 60 cam the sides of the clutch away from each other. The upward movement is achieved by means of the pin 19 (FIG. 2) which presses upwardly on the bottom of the clutch when a wire is to be inserted.

A clearing bar 61 is arranged along each row of clutches. The purpose of the clearing bar is to bend a wire which has been inserted in a clutch into position substantially in a channel 62 which runs alongside each row of clutches. By having the wire in the channel 62 any interference between the wire and a further wire to be inserted in the same or an adjacent clutch is avoided. Each of the three clearing bars 61 of a cluster 31 is connected to a push rod 63. The push rod 63 extends across the holding table 21, that is, in the transverse or Y direction and therefore the clearing bars of all the clutch clusters in a line across the table 21 are connected to the same push rod 63. The clearing bars 61 are mounted for pivotal sliding movement in pivots 64 such that axial movement of the push rod 63 in the direction shown in FIG. 4 causes the bars 61 to move from the position shown, in a curved path across the top of the holding clutches as shown by the dotted lines.

Initially, prior to insertion of a wire in a clutch 32 the push rod is pneumatically actuated to move the bars across the top of the clutches and after the wire has been inserted and held by a clutch the rod 63 is returned to its original position by spring action causing the wire to bend downwardly into the respective channel 62. A post 65 is arranged at each end of each row of clutches 32. The posts 65 provide means around which a wire may be bent in order to follow a predetermined path between two clutches 32.

Reference should now be made to FIGS. 7 an 8 which are sectional views showing the returning mechanism 42 and blade arrangement in more detail. The returning mechanism 42 includes spaced opposed discs 66 which are mounted for rotation on side members 67. The opposed surfaces of the discs 66 are knurled for gripping a wire and each disc has an attached gear for meshing with a geared sector 68. The geared sector 68 is slotted at 69 to provide cam surfaces which bear on fixed boss 70. The boss 70 is mounted on bracket 90 which is fixed to end portion 54. Also fixed to bracket 90 is an idler wheel 91 which bears on a cam plate 92 fixed to the side member 67. The idler wheel 91 and cam plate 92 ensure that the disc 66 are kept very close together when in their downward position to avoid interference with the posts 65 when a wire is being inserted into a clutch 32 immediately adjacent a post 65. The sector 68 is pivoted on side member 67 by pivot pin 71.

The discs 66 may be brought together pneumatically be actuation of pistons 73 located in cylinders 72. The pistons 73 located in cylinders 72. The pistons 73 are fixed to a vertial sliding member 74 and therefore pressure in cylinders 72 causes the side members 67 to move together by sliding on horizontal shafts 76. The vertical sliding member 74 is slidably mounted on vertical shafts 75 and can be caused to slide vertially by air pressure to cylinder 43. The cyliner 43 is mounted on flange 77, which is fixed to the end portion 54 and actuates the vertical sliding member 74 by shaft 78 and bracket 79. The operation of the returning mechanism 42 will be apparent from the description of the operation of the machine included hereinafter.

The blade arrangemet is shown in FIS. 7 and 8 to comprise three pairs of longitudinal blades 80, 81 and 82, respectively, The upper blades 80 and the lower blades 82 are stripping blades for stripping insulation from the end of a cut wire and the central blades 81 are cutting blades for completely severing a wire. All the blades are elongated flat plates which have an oval shaped aperture with bevelled edge as shown in FIG. 8. The aperature of the cutting blade 81 is smaller than those of the stripping blades such that sliding movement of the two blades of cutting blade 81 in opposite directions relative to each other completely closes the aperture whereas the same relative sliding movement of the pairs of blades constituting the stripping blades 80 and 82 leaves a small aperature. The small aperture is sufficient for the wire but not the insulation to pass through and therefore the insulation of a wire passing through the blades is cut when the blades are actuated.

Relative sliding movement of the blades is controlled by a piston and cylinder arrangement located in the blade cylinder 56. The bottom blade of the stripping blades 80 and 82 is connected to a piston 83 by a coupling arrangement 84 as is the top blade of the cutting blade 81. It should be noted that the bevels of the cutting blade 81 are inverted with respect to the bevels of the stripping blades 80 and 82. This feature is important because if all the bevels are all the same way there is a tendency for the wire to bend rather than cut. The upper blade of each pair of stripping blades and the lower blade of the cutting blade is connected to a cylinder 85 in which piston 83 is adapted to slide and cylinder 85 is slidably mounted in the blade cylinder 56. Thus air pressure in chamber 86 causes the piston 83 to move in the direction shown until movement is limited by stop 87, which passes completely through the cylinder 56, engaging coupling 84. The cylinder 85 then moves in the direction shown until it engages the other side of stop 87. In such a position the aperture of the cutting blade is closed and the aperture of the stripping blades is very small only allowing the wire to pass and not the wire with insulation. The relative movement of the blades may be altered to allow for different wires by sliding the stop 87 which is of varying thickness. The piston 83 is double acting to enable the blades to be returned to the original or open position.

The returning mechanism 42 includes an adjustment mechanism for adjusting the spacing between the discs 66 when the discs are in the closed position. The adjustment mechanism limits te movement of side members 67 towards each other and comprises a limiting block 93 which, in plan view, is wedge shaped. The block 93 engages complementary surfaces on side members 67 and is suspended from bracket 79. The block 93 is adjustable by means of nut 94. By adjustment of the block 93 the discs 66 are prevented from completely closing and are made to grip the wire firmly without damaging the wire insulation.

FIG. 7 shows a pencil 45 and associated wire clutch mechanism 46. A neck portion 95 of the clutch 46 slides over the top of the pencil 45. All the pencils 45, except the pencil in the operating position are supported in a vertically neutral position by a annular rib (not shown) on the outer surface of hub 96. A further similar annular rib (not shown) on the hub 96 holds the clutch mechanism 46 in a vertically neutral position. The neutral position is a vertical position relative to the drum as shown by the pencil in FIG. 7. The hub 96 has a vertical slot in radial alignment with the active pencil 45, that is, the pencil in use. Discs 97 and 98 which slide vertically within the hub have respective protrusions 99 and 100 which engage with the cut outs of the active clutch 46 and pencil 45, respectively through the vertical slot. The disc 99 has an upright flange 101 which supports the air cylinder 47 for actuating the clutch 46 via shaft 48. The disc 97 also supports the cylinder 49 which is rigidly affixed to the disc 97 and is connected to the disc 98 by rod 103. The pistion of cylinder 49 is actuated to move the clutch 46 vertically relative to the pencil 45. The disc 98 supports a piston and cylinder 50 which is rigidly affixed thereto and which is connected to the hub 96 by connecting rod 102. Actuation of the piston and cylinder 50 causes vertical movement of the pencil 45 relative to the cylinder of the indexing head 22. The piston and cylinder arrangements 47, 49 and 50 are double acting to enable return to the initial position and cylinder 50 also has an intermediate position for reasons which will become apparent below.

All the piston and cylinder arrangements of the machine are operated by air pressure controlled by electric-valves (not shown). An electronic sequencer (not shown) times the operation of all the electro-valves to ensure that all operations are performed at the appropriate time in a cycle.

Having described the important features of the machine according to one embodiment the operation will now be described with the aid of FIGS. 9 to 13 which diagramatically illustrate a pencil 45 together with its associated clutch 46 the cutting and stripping blades 80, 81 and 82 respectively, the discs 66 of the re-introducing mechansim and a holding clutch 32 and its associated clearing bar 61.

In use the machine operates as follows: A pre-programmed punch tape is installed in the numerical controller 37 and the first operation is the movement of the holding table, transverse slide and rotary indexing head to the zero or reset position if this has not already been done. In other words the transverse slide 29 is moved into a position designated zero in the Y direction, the rotary indexing head 22 is rotated to bring a predetermined pencil into alignment with the $z$ axis and the holding table is moved to a predetermined zero position of the $x$ axis. The holding table 21 and transverse slide 29 are then directed to a programmed $x$-$y$ co-ordinate, that is, the zero position pencil is aligned with a clutch on the holding table represented by a particular $x$-$y$ co-ordinate. Once the programmed $x$-$y$ co-ordinate is reached the head is rotated to bring a programmed pencil into alignment with the clutch and the wire of that pencil is introduced into the clutch in the manner described below assuming that the machine has not been previously operated and that all wires have been inserted into their respective pencils to a position substantially as shown diagrammatically in FIG. 9.

Firstly, the clutch 46 at the top of the active pencil 45 is moved downwardly relative to the pencil by actuation of piston and cylider 49. It can be seen from the illustration of FIG. 9 that the clutch 46 holds the wire at all times unless the lever 105 is acted upon by shaft 48. The lever 105 is spring biased to hold the wire. The relative downward movement of the clutch 46 is 10 mm which causes the end of the wire to project through the cutting blade 81. The blades of each pair of blades are then acutated by air pressure in cylinder 86 to slide relative to each other. The sliding movement causes the cutting blade 81 to sever the wire, cutting off a small length of wire whilst the top stripping blade 80 cuts through the insulation of the wire but leaves the actual conductor of the wire untouched.

Figure 10:
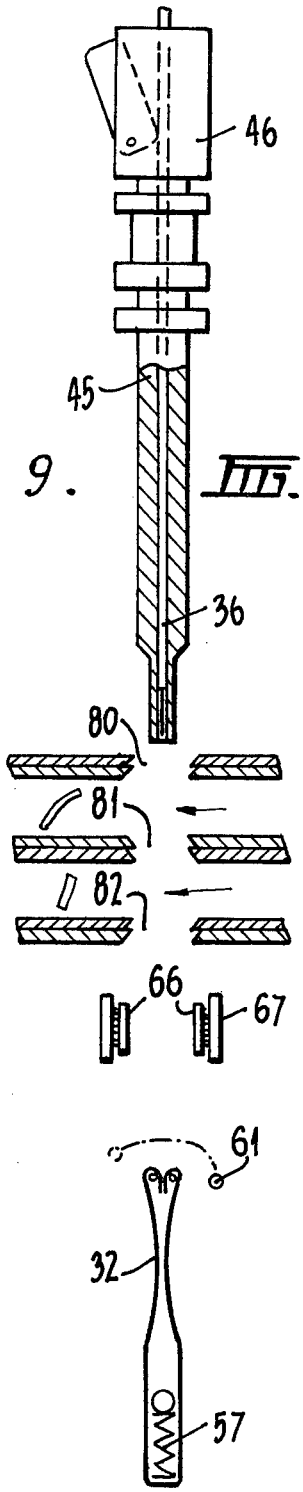

The next operation is to return the clutch 46 to its original position which, because the clutch 46 is firmly holding the wire, causes the wire to take up the position shown in FIG. 10 with the insulation stripped from the end. The blades are then opened, that is returned to their original position and the apparatus assumes the position shown in FIG. 10.

A blowout air jet longitudinal of the blades from an outlet jet (not shown) causes the stripped insulation and cut piece of wire to be blown clear so that they cannot interfere with the operation of the machine. The air jet is indicated by the arrows of FIG. 10.

The next operation in the sequence is to simultaneously move the pencil 45 and clutch 46 downwardly. Prior to this operation the clearing bar 61 is opened that is, moved upwardly and across the top of the clutch 32 to the other side and the clutch 32 is opened by actuation of the pin 17. The pencil 45 is moved to a position wherein the bottom of the pencil extends through the blade and assumes a position slightly above the clutch 32. The operation is effected by actuation of the piston in cylinder 50. Next the piston of cylinder 49 is actuated to move the clutch 46 downwardly relative to the pencil 45 causing the stripped end of the wire to move into the open clutch 32. The clutch 32 is now released to grip the wire and the pencil clutch 46 is released by actuation of the piston of cylinder 47 to free the wire which can then slide through the pencil 45. The pencil 45 is then retracted upwards into an intermediate running position which is about half way between the fully down and the reset or neutral position.

Figure 11:
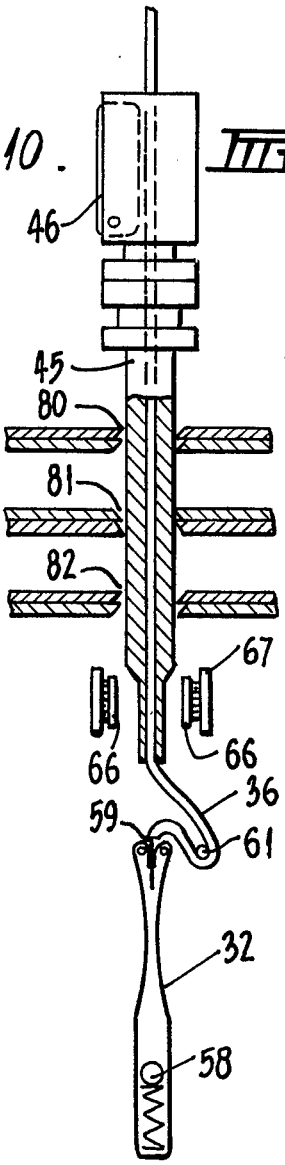
Figure 12:
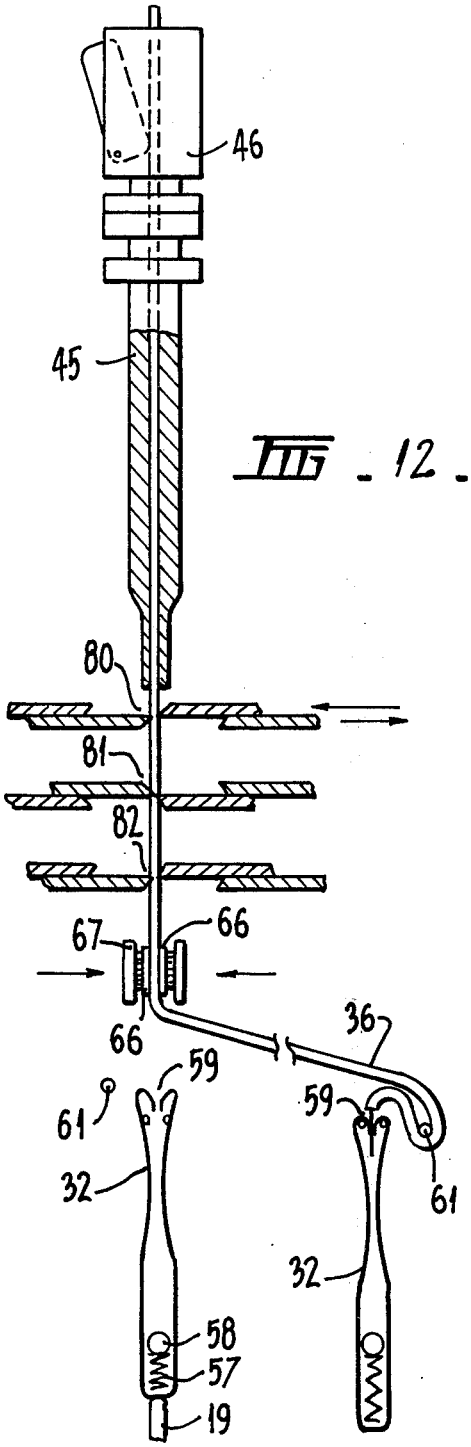
Figure 13:
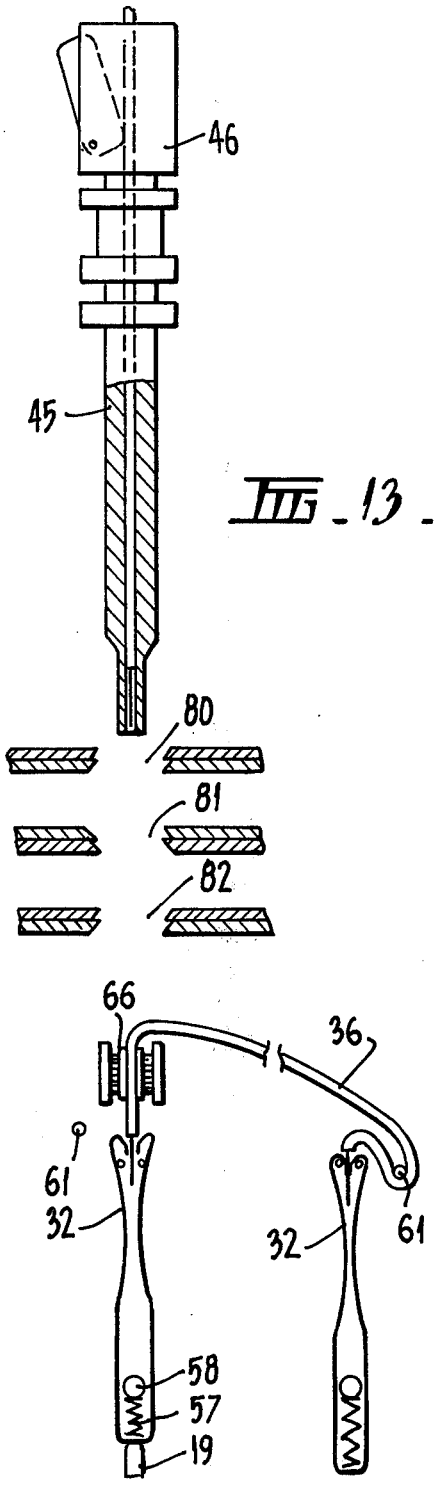

The running position of the pencil is shown in FIG. 11, which also shows the clearing bar in the closed or retracted position which causes the wire to bend clear of the clutch 32. The holding table is then acutated by stepping motor 24 to move in the *x* direction a small amount to place the active pencil 45 in a position over the end of the particular clutch cluster in use.

The transverse slide may then be acutated to run the wire to a predetermined position on the *y* axis and by alternate operation of motors 24 and 26 the active pencil is placed above any particular clutch of the table. The route followed by the pencil between the start and finish of a wire run is pre-programmed on the punch tape. It should be noted that in travelling to a new start position after termination the motors 24 and 26 may operate simultaneously because the bottom of the pencil is clear of the posts 65.

Upon reaching the termination point the pencil 45 retracts completely to the reset or start position and the discs 66 are moved into position by actuation of pistons 73, to firmly grip the wire. The cutting and stripping blades are then closed such that the cutting blade 81 completely severs the wire and the stripping blades 80 and 82 cut the insulation. The terminating clutch 32 and the clearing bar 61 are opened and next the clutch lever 105 is released to firmly grip the wire. The apparatus assumes the position illustrated in FIG. 12.

Actuation of the piston in cylinder 43 causes the returning mechanism 42 to move downwardly and the first stage of downward movement stops when the pin 70 has moved along the first vertical section of the cam 69. This downward movement strips the insulation from the upwardly projecting end of the cut wire by virtue of stripping blade 82. The pencil clutch 46 is then returned to its original position, that is, moved upwardly 10mm relative to the pencil 45 and this movement strips the insulation from the downwardly projecting end of the cut wire by virtue of stripping blade 80 and leaves the wire in the pencil ready for the next operation.

The blades open and the blowout airjet removes the stripped insulation. In the next operation the returning mechansim 42 descends further and the cam 69 causes the discs to rotate through 180° thus inverting the upwardly projecting wire end. Further downward movement of the returning mechansim inserts the wire into the terminating clutch 32. The apparatus is then in the position shown in FIG. 13. All that remains to complete the operation is for the clutch 32 to close, the discs 66 to release the wire, the returning mechansim 42 to return to its original position and the clearing bar 61 to be reset. Once these operations have been completed the machine is in position ready for the next wire running operation. When the active pencil is moved over the next table clutch 32 the wire is ready for insertion since the insulation has already been stripped during the previous wire run.

The above described operation is repeated for each wire to be run in the same colour group and size. The pencil containing the next wire to be used is then indexed into the active position and the aforementioned operation is repeated until the entire cable is manufactured.

On completion of the cable the indexing head 32, the transverse slide 29 and the holding table 21 are directed to the reset or start position. The last command on the tape program automatically rewinds the program tape 39 and disables the numerical controller awaiting instruction to repeat the sequence.

A further feature of the embodiment which is not shown in the drawings and which has not been described above relates to a checking circuit for ensuring that each wire is properly introduced into a holding clutch and as the insulation stripped from the end.

The checking circuit inhibits control of the machine to stop the program and the operation of the machine if a wire is not properly stripped and introduced or if the wire being fed to the machine is broken or runs out. The checking circuit consists essentially of a dual transistor relay drive circuit which is inactive or grounded during normal operation of the machine and which becomes active to inhibit the control when some abnormality occcurs. A microswitch is mounted for actuation by the active pencils. The microswich is closed when the active pencil is in the upward or neutral position to connect the checking circuit to the grounded frame of the machine. When the active pencil is in the downward position and a stripped wire has been introduced into a holding clutch the microswitch is open and the circuit is grounded through the wire which has been intoduced. In other words each of the wires of the respective spools mounted above the machine has one end connected to the checking circuit whilst the other end is fed through the respective pencil for use during operation of the machine. If a wire is not introduced into a holding clutch or if the insulation is not stripped the earth does not appear on the checking circuit and consequently the control is inhibited. Similarly, if the wire breaks or runs out the inhibit occurs. The checking circuit prevents cable forming errors in the form of missing wires which could occur if a wire is not introduced into a clutch and also ensures that all wires of the form have electrical continuity. The checking circuit enables the machine to be operated without an operator being continually present to ensure proper wire feeding. An audible alarm may be connected to the checking circuit to sound when an inhibit occurs.

The holding table 21 is removable from the machine so that on completion it may be removed and a further cable formed whilst the previously completed form is strapped together and removed from its holding table.

It should be apparent from the above described embodiment that the invention provides a cable forming machine which significantly reduces the manual laobour required to produce a cable and increases productivity and versatility. Furthermore, cable forming errors are virtually eliminated and there is a reduction in procsss handling.

It should also be apparent that modifications and additions may be readily effected by persons skilled in the art. Of course the configuration of the holdiing table clutches may be altered and the gearing from the stepping motors altered accordingly so that the machine may produce cable forms for apparatus other than the relay sets described above. By including a further stepping motor arrangement to move the transverse slide 29 in a vertical direction the machine may manufacture three dimensional cable forms as well as the planar forms described above.

We claim

1. A machine for manufacturing cable forms, said machine including a plurality of holding clutches for securely holding the ends of wires being used to make the cable form, said holding clutches being arranged in spaced relationship to simulate the relative spacing of terminals to which said wires will, in use, be connected, wire feed means moveable automatically relative to said clutches for introducing the end of a pre-selected wire into a predetermined one of said clutches and routing said wire along a predetermined path to a further predetermined one of said clutches, cutting and stripping blades for automatically cutting said wire and stripping the insulation adjacent the cut end prior to said introducing and, after said routing, for cutting the wire and stripping the insulation from adjacent the end of the routed wire, returning means for rotating and introducing said last mentioned end into said further clutch, and control means for controlling the operation of said machine.

2. A machine as defined in claim 1 wherein said wire feed means is adapted to introduce any one of a plurality of different wires into said predetermined clutch, the selected wire being indexed into an active position prior to said wire introducing operation.

3. A machine is defined in claim 2 wherein said wire feed means includes a plurality of elongated tubes, each tube accomodating one of said plurality of different wires which is adapted to slide through said tube, said wire feed means being operable to bring any one of the tubes into said active position wherein the tube may be slid longitudinally relative to the wire feed means.

4. A machine as defined in claim 3 wherein said holding clutches are arranged on a holding table spaced beneath said wire feed means, the plane of the holding table being perpendicular to said active tube and said holding table being mounted on a frame to slide in one direction perpendicular to said active tube, said wire feed means being slidably mounted on said frame by means of a transverse slide for sliding in a direction transverse of the sliding direction of said holding table.

5. A machine as defined in claim 4 wherein said wire feed means comprises a rotary indexing heat in the form of a cylinder having said plurality of tubes spaced around the cylinder in parallel with the longitudinal axis thereof, said cylinder being rotatable to bring any one of the tubes into said active position.

6. A machine as defined in claim 5 wherein said active tube is adapted for downward sliding movemnt to a position wherein the bottom of the tube is closely adjacent said predetermined holding clutch.

7. A machine as defined in claim 6 wherein each of the tubes of the rotary indexing head has a clutch mechanism adpated to hold or release the wire passing through the tube, each clutch mechanism also being adapted for vertical sliding movement with its respective tube or with respect to its respective tube.

8. A machine as defined in claim 7 wherein said cutting and stripping blades are mounted on said transverse slide in a position adjacent and below the active tube of the indexing head said downward movement of the active tube causing it to pass completely through apertures in the respective blades.

9. A machine as defined in claim 8 wherein said returning means is mounted on said transverse slide and includes spaced opposed discs arranged in a position adjacent and below said blades, said discs being adapted to hold a wire passing therebetween and being adapted for rotation through 180° and vertical movement between said blades and said holding clutches.

10. A machine or manufacturing cable forms said machine including a plurality of holding clutches for securely holding the ends of wires being used to make the cable form, said holding clutches being arranged on a holding table in spaced relationship to simulate the relative spacing of terminals to which said wires will, in use, be connected, wire feed means for indexing any one of a plurality of different wires into an active position, said holding table being mounted on a frame for slidable movement in one direction in the plane of the table and said wire feed means being mounted on said frame above said table for slidable movement in a direction transverse of the sliding direction of said table said sliding movement of said table and said wire feed means enabling the wire in said active position to be disposed over any predetermined one of said holding clutches for introduction into said clutch and routing along a predetermined path to any further predetermined one of said clutches, cutting and stripping blades for automatically cutting said wire and stripping the insulation at the cut end prior to said introducing and, after said routing, for cutting the wire and stripping the insulation at the end of the routed wire, returning means arranged between said holding table and said wire feed means for rotating for introducing said last mentioned end into said further predetermined one of said clutches, and control means for controlling the operation of said machine,

11. A machine for forming a plurality of wires into a predetermined cable form with the ends of said wires being positioned for insertion into electrical terminals comprising:

a plurality of holding clutches for securely holding the ends of said wires, said holding clutches being spaced with respect to one another to simulate the relative spacing of said terminals to which the ends of said wires in said cable form will be connected, wire feed means for introducing the end of a preselected wire into a predetermined one of said clutches, means for cutting said preselected wire, means for stripping a fixed length of insulation from the cut end of said wire, said predetermined clutch holding the stripped end of said preselected wire, means for routing said prselected wire from said predetermined holding clutch to a second holding clutch spaced with respect to said first holding clutch, means for cutting said routed end of said wire, means for stripping a fixed length of insulation from said routed end of said wire, means for rotating said routed end of said wire into alignment with said second holding clutch, and means for inserting said stripped end of said routed wire into said second holding clutch.

12. The machine of claim 11 wherein said holding clutches are mounted on a holding table and wherein said means for routing includes means for moving said holding table with respect to said wire feed means.

13. The machine of claim 11 wherein said holding clutches are aligned in rows with said rows being divided by a plurality of channels aligned perpendicularly with respect to said rows and wherein said routing means further comprises means for positioning said preselected wire between said rows of holding clutches and in said channels as said wire is routed from said predetermined holding clutch to said second holding clutch.

14. A machine for manufacturing cable forms, said machine including a plurality of holding clutches for securely holding the ends of wires being used to make the cable form, said holding clutches being arranged on a holding table in spaced relationship to simulate the relative spacing of terminals to which said wires will, in use, be connected, wire feed means for indexing any one of a plurality of different wires into an active position, said holding table being mounted on a frame for slidable movement in one direction in the plane of the table and said wire feed means being mounted on said frame above said table for slidable movement in a direction transverse of the sliding direction of said table, said sliding movement of said table and said wire feed means enabling the wire in said active position to be disposed over any predetermined one of said holding clutches for introduction into said clutch and routing along a predetermined path to any further predetermined one of said clutches, cutting and stripping blades for automatically cutting said wire and stripping the insulation at the cut end prior to said introducing and, after said routing, for cutting the wire and stripping the insulation at the end of the routed wire, returning means arranged between said holding able and said wire feed means for introducing said last mentioned end into said further predetermined one of said clutches, and control means for controlling the operation of said machine, wherein said blades are mounted adjacent and below said wire feed means, said returning means including spaced opposed discs arranged in a position adjacent and below said blades, said discs being adapted to hold a wire passing therebetween and being adapted for rotation through 180 ° and vertical movement between said blades and said holding table.

15. A machine as defined in claim 14 wherein said cutting and stripping blades are vertically spaced and comprise two stripping blades with said cutting blade disposed therebetween, each of said blades comprising a pair of elongated flat plates having apertures therethrough, which apertures are aligned in the open or inactive position of the blades, said apetures having bevelled edges and sliding movement of the plates of each blade in opposite directions causing the aperture of the cutting blade to close and consequently sever a wire passing therethrough and the aperture of the stripping blades to close sufficiently to cut the insulation of a wire passing therethrough, the bevels of the cutting blade being inverted with respect to the bevels of the stripping blades, the upper of said stripping blades being adapted to strip the insulation from the end of a wire to be inserted into a holding clutch at the start of a wire routing operation and the lower stripping blade being adapted to strip the insulation from the end of a routed wire prior to insertion in a holding clutch.

16. A machine as defined in claim 15 wherein said opposed discs are mounted on respective side members, each disc being geared to a plate pivotally mounted on the side member, pivotal movement of the plate causing the disc to rotate through said 180 °, said pivotal movement being provided by a cam surface on said plate camming on a fixed boss on said transverse slide during said downward movement of the discs, said side members being slidably mounted for movement towards each other when actuated pneumatically to cause the discs to hold a wire passing therebeween.

17. A machine as defined in claim 16 wherein said side members are slidably mounted on a vertical sliding member, said vertical sliding member being slidably mounted on said transverse slide and being pneumatically actuated to move said side members and hence said discs downwardly, the rotation of the discs occuring substantially mid-way along said downward movement of said discs.

18. A machine as defined in claim 17 wherein a checking circuit is provided to ensure that each wire to be routed by the machine is properly introduced into a holding clutch at the start of each routing operation with the insulation stripped from the end, said checking circuit being adapted to detect electrical contact between the introduced wire and the frame of the machine immediately after the wire introducing operation, and in the absence of electrical contact to establish an inhibit condition to stop said control means.

19. A machine as defined in claim 18 wherein a clearing bar is arranged adjacent the top of each holding clutch, said clearing bar being actuated to bend the wire clear of said clutch after each wire introducing operation to prevent interference between a routed wire and a further wire being subsequently introduced.

20. A machine as defined in claim 19 whrein said wire feed means comprises a rotary indexing head in the form of a cylinder having a plurality of elongated tubes spaced around the cylinder in parallel with the longitudinal axis thereof, each of said tubes accomodating one of said plurality of different wires, each wire being adapted to slide through its respective tube, said cylinder being rotatable to bring any one of the tubes into said active position wherein the tube may be slid longitudinally relative to the cylinder.

21. A machine as defined in claim 20 wherein said longitudinal sliding movement of the active tube is vertical movement whereby the tube may be caused to extend through the apertures of said blades and between said spaced opposed discs to a position wherein the bottom of the tube is closely adjacent said predetermined holding clutch.

22. A machine as defined in claim 21 wherein each of the tubes of the rotary indexing head has a clutch mechanism adapted to hold or release the wire passing through the tube, each clutch mechanism also being adapted for vertical sliding movement with its respective tube or with respect to its respective tube.

23. A machine as defined in claim 22 wherein a compacting bar is arranged above said holding clutches, said compacting bar being operable after each introducing operation to press downwardly on said wires to cause said wires to be packed together.

24. In a method for forming a plurality of wires into a predetermined cable form, a machine including a plurality of holding clutches for securely holding the ends of said wires, said holding clutches being spaced with respect to one another to simulate the relative spacing of terminals to which the ends of said wires in said cable form will be connected, said clutches being mounted on a holding table, said table being movable with respect to a wire feed means, the method of forming said cable comprising the steps of:

positioning a preselected wire with respect to a predetermined one of said holding clutches by moving said table with respect to said feed means until the predetermined holding clutch is proximate said preselected wire, stripping a fixed length of insulation from said preselected wire, introducing the stripped end of said preselected wire into said predetermined holding clutch, routing said preselected wire to a position proximate a second holding clutch by moving said holding table with respect to said wire feed means, cutting the routed end of said wire, stripping a fixed length of insulation from said cut end of said wire, rotating said routed end of said wire into alignment with said second holding clutch, and inserting said end of said wire into said second holding clutch.

25. The method of claim 24 wherein said wire feed means includes means for retaining a plurality of wires and further comprising the step of selecting said preselected wire by moving said wire feed means until said preselected wire is aligned with a means for moving said wire with respect to said holding clutch.

26. The method of claim 25 wherein said stripping step comprises the step of moving said selected wire between a wire stripping means, closing said stripping means about said wire at a fixed distance from the end of said wire, and withdrawing said wire away from said stripping means and into said wire feed means, said withdrawing movement causing the insulation along a fixed length of said selected wire to be stripped therefrom.

27. In a method for forming a plurality of wires into a predetermined cable form, a machine including a plurality of holding clutches for securely holding the ends of said wires, said holding clutches being spaced with respect to one another to simulate the relative spacing of terminals to which the ends of said wires in said cable form will be connected, said clutches being mounted on a holding table, said table being movable with respect to a wire feed means, said wire feed means including means for retaining a plurality of wires, the method of forming said cable comprising the steps of selecting a preselected wire by moving said wire feed means until said preselected wire is aligned with a means for moving said wire with respect to said holding clutch, positioning a preselected wire with respect to a predetermined one of said holding clutches by moving said table with respect to said feed means until the predetermined holding clutch is proximate said preselected wire, stripping a fixed length of insulation from said preselected wire, introducing the stripped end of said preselected wire into said predetermined holding clutch, routing said preselected wire to a position proximate a second holding clutch by moving said holding table with respect to said wire feed means, cutting the routed end of said wire, said cutting step including the steps of passing said wire between a pair of cutting blades, said cutting blades being positioned between said feed means and said second holding clutch, clamping the end of said routed wire on the side of said cutting blades proximate said second holding clutch, cutting said wire by closing said cutting blades, and rotating said clamping means until the cut end of said routed wire is aligned with said second holding clutch, stripping a fixed length of insulation from said cut end of said wire, sid stripping steps comrpising the steps of moving said selected wire between a wire stripping means, closing said stripping means about said wire at a fixed distance from the end of said wire, and withdrawing said wire away from said stripping means and into said wire feed means, said withdrawing movement causing the insulation along a fixed length of said selected wire to be stripped therefrom, and inserting said end of said wire into said second holding clutch.

28. The method of claim 27 wherein said holding clutches are formed in a plurality of rows spaced with respect to one another and wherein said rows are intercepted by a plurality of channels extending substantially perpendicular to said rows and wherein said routing step further comprises the step of positioning said preselected wire into one of the spaces between said rows of holding clutches after said wire has been introduced into said predetermined holding clutch, and maintaining said prselected wire in said spaces between said rows of holding clutches and in said channels en route to said second holding clutch.

* * * * *